US006863730B2

(12) United States Patent
Trabold et al.

(10) Patent No.: US 6,863,730 B2
(45) Date of Patent: Mar. 8, 2005

(54) COATING DIE WITH LASER POSITION SENSORS

(75) Inventors: Thomas A. Trabold, Pittsford, NY (US); Robert F. Dunham, Walworth, NY (US); John M. Hammond, Livonia, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/369,810

(22) Filed: Feb. 19, 2003

(65) Prior Publication Data

US 2003/0157243 A1 Aug. 21, 2003

Related U.S. Application Data

(63) Continuation of application No. 09/953,526, filed on Sep. 17, 2001, now Pat. No. 6,706,315.

(51) Int. Cl.[7] ..... B05C 5/00

(52) U.S. Cl. ..... 118/324; 118/DIG. 4; 118/690; 118/691; 118/416; 118/712; 118/672; 427/8

(58) Field of Search ..... 118/690, 691, 118/324, 416, 712, 672, DIG. 4, 419, 692, 409, 413, 680, 665; 162/198, 263; 427/8, 9, 434.2; 425/414, 466, 141

(56) References Cited

U.S. PATENT DOCUMENTS 4,143,187 A * 3/1979 Pilgrim et al. ..... 427/358
4,656,048 A * 4/1987 Kudoh et al. ..... 427/8
4,762,578 A * 8/1988 Burgin et al. ..... 156/64
5,358,673 A * 10/1994 Heller et al. ..... 264/401
5,401,529 A * 3/1995 Wollam ..... 427/8
5,434,566 A * 7/1995 Iwasa et al. ..... 341/34
5,720,820 A * 2/1998 Boger et al. ..... 118/669
5,876,500 A * 3/1999 Kurimoto ..... 118/669
6,106,671 A * 8/2000 Heaven et al. ..... 162/198
6,106,900 A * 8/2000 Innes et al. ..... 427/358
6,214,513 B1 4/2001 Cai et al. ..... 430/129
6,309,692 B1 * 10/2001 Nakamura et al. ..... 427/8
6,344,088 B1 * 2/2002 Kamikihara et al. ..... 118/712

FOREIGN PATENT DOCUMENTS

EP 0 876 848 A1 * 11/1998 ..... B05C/1/02

* cited by examiner

*Primary Examiner*—Chris Fiorilla
*Assistant Examiner*—Michelle Acevedo Lazor
(74) *Attorney, Agent, or Firm*—Eugene O. Palazzo; Fay, Sharpe, Fagan, Minnich & McKee, LLP

(57) ABSTRACT

An apparatus including: a movement device that moves an object to be coated; a slot die coater equipped with a position sensor mounted on at least one end of the slot die coater and which slot die coater controllably dispenses coating material onto the moving object; and at least one servor motor-controller system in electrical contact with the position sensor, wherein the position sensor senses the position of the slot die coater relative to the object and wherein the at least one servor motor-controller system adjusts the position of the slot die coater relative to the object if the position of the slot die coater relative to the moving substrate deviates from a set of predetermined coordinates.

7 Claims, 3 Drawing Sheets

COATING DIE WITH LASER POSITION SENSORS

CROSS REFERENCE TO COPENDING APPLICATIONS AND RELATED PATENT

This is a Divisional of application Ser. No. 09/953,526, filed on Sep. 17, 2001 now U.S. Pat. No. 6,706,315.

Attention is directed to commonly owned patents and copending applications:

U.S. Pat. No. 6,214,513, discloses a coating process for the fabrication of organic photoreceptors which process employs an electrically conductive single slot die biased to allow an electric field between the die and the ground plane on the photoreceptor substrate. The homogenous coating dispersion is fed through the die at a predetermined gap and rate to control coating thickness at the same time that an electric field is applied. The formulation, rheology, particle mobility, coating speed, electric field and the like are controlled so that the photogenerator particles migrate to the substrate in the dwell time defined by the coating die region.

U.S. Ser. No. 09/716,412, filed Nov. 21, 2000, discloses a coating apparatus which includes a coating device that dispenses coating material, a rotation device that rotates an object to be coated, and a movement device that effects relative movement of the coating device and the rotation device in a direction parallel to a rotation axis of the rotation device. The coating device in a specific embodiment includes a slot, extending substantially parallel to the rotation axis of the rotation device, through which the coating material is dispensed. A relationship of (a) a ratio R of an angular speed of rotation of the rotation device to a speed of the relative movement and (b) a length L of the slot is $R=2\pi/L$.

The disclosures of each of the above mentioned patent and copending applications are incorporated herein by reference in their entirety. The appropriate components and processes of these patents may be selected for the toners and processes of the present invention in embodiments thereof.

BACKGROUND OF THE INVENTION

The present invention is generally directed to an apparatus and processes for treating, such as by coating substrates, and more specifically, to a coating apparatus including a coating die with one or more laser position sensors and which coating die enables coating processes that deliver precise coating layer thicknesses and widths to, for example, cylindrical, sheet, or web substrates. The resulting precision coated substrates provide articles or devices that are useful in, for example, printing systems and printing processes such as organic film coated drum photoconductors, thermal fusing rolls, and the like useful articles. The apparatus and coating processes of the present invention can be adapted to provide value-added and enhanced performance capabilities to known printing and copying devices, such as printers, copiers, facsimile, and related multifunction printing devices.

In embodiments of the present invention can be readily adaptable to the manufacture of precision coated articles, such as, photoreceptor rolls and drums, fuser rolls, backer rolls, cleaning rolls, specialty coated papers or transparency stock, photoreceptor web stock, coated paper web stock, and the like articles or materials.

In embodiments, the coating processes of the present invention provide valuable benefits and excellent satisfaction levels in the manufacturer of coated articles and apparatus or devices incorporating the coated articles, for example, in providing coater articles with uniform coating thicknesses and homogenous coating layers, in avoiding materials waste or reducing manufacturing cycle times and costs, and in downtime and productivity losses associated less efficient coating methods and apparatuses. These and other advantages of the present invention are achievable.

There remains a need for reducing defects resembling brush marks along each edge of the deposited coating. These brush marks can remain as defects in the dried coating and can ultimately print out as undesirable artifacts in the final electrophotographic copy.

In a typical electrostatographic printing system, a light image or digital image of an original to be reproduced is recorded in the form of an electrostatic latent image upon a photosensitive member such as an organic photoconductor and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused, for example with a thermal or radiant fuser roll, upon a support which may be the photosensitive member itself or another support sheet such as plain paper. Other related marking technologies are known, for example, liquid immersion development, and solid or liquid ink jet imaging technologies wherein a liquid, solid, molten, sublimed, and the like marking formulations are deposited onto an imaging member, imaging intermediate member, or image receiver.

In the dip coating process, a cylindrical drum is dipped into a tank of coating material and then withdrawn, with a portion of the coating material adhering to the drum. The adhered coating material is then allowed to cure.

In the slot die coating process, coating material is caused to flow through a slot while a photoreceptor belt of a width approximately equal to the length of the slot is fed past the slot in a direction transverse to the length of the slot.

PRIOR ART

It is difficult to slot coat a high quality single layer coating of a charge generation layer onto a substrate primarily because of generally low liquid viscosity of the coating, shear thinning and yielding stress due to the nature of the dispersion and the typically extremely thin layer requirements. For example, the benzimidazole perylene (BzPe) and Hydroxygallium phthalocyanine (HOGaPc) solutions that are used to produce photoreceptors have very narrow coating windows. Thus, a need exists for improved coating methods that provide higher yield and higher quality of coated substrates.

In U.S. Pat. No. 6,106,671, issued Aug. 22, 2000, to Heaven, et al., there is disclosed an apparatus and method for controlling the size of a gap through which material is metered. The gap is defined by a rigid surface and a flexible surface connected to at least one actuator for deforming the flexible surface. A plurality of sensors are positioned along the rigid or flexible surfaces to detect the other of the surfaces and generate signals indicating its position. A computing unit in communication with the plurality of sensors processes the signals to generate a continuous gap measurement profile. The computing system also stores a predetermined desired gap measurement profile. A control system in communication with the computing unit actuates the actuators to deform the flexible surface to adjust the gap measurement profile to correct any deviation from the desired gap measurement profile.

In U.S. Pat. No. 5,358,673, issued Oct. 25, 1994, to Heller, et al., there is disclosed a solid three-dimensional article formed from a liquid medium by initially coating a layer of the liquid medium on a fixedly mounted apertured support plate. An initial cross-section or profile of the article then is formed by solidifying the liquid medium, or at least a portion thereof, on the support plate. In another embodiment, each layer of the liquid medium is formed by dispensing the entire layer from above the fixed support plate. In a further embodiment, a device is disclosed for dispensing a liquid medium in layers of uniform thickness on the medium surface of a laser modeling machine, for solidification when subjected to prescribed energy. The dispenser contains an elongated applicator or coating bar of rectangular, essentially solid construction, with a liquid medium reservoir and dispensing passageways located adjacent a dispensing side of the bar. A feed tube and traversing mechanism support rods are secured to an opposite side of the bar. The dispensing passageways may be apertures arranged in multiple rows, with the apertures in at least one row offset with respect to the apertures in the other rows, for more uniform dispensing. In the alternative, the passageways may be inclined slots having portions overlapping in a direction extending longitudinally of the bar.

In U.S. Pat. No. 6,214,513, issued Apr. 10, 2001, to Xerox Corporation, there is disclosed a coating process for the fabrication of organic photoreceptors employs an electrically conductive single slot die biased to allow an electric field between the die and the ground plane on the photoreceptor substrate. The homogenous coating dispersion is fed through the die at a predetermined gap and rate to control coating thickness at the same time that an electric field is applied. The formulation, rheology, particle mobility, coating speed, electric field and the like are controlled so that the photogenerator particles migrate to the substrate in the dwell time defined by the coating die region The aforementioned references are incorporated in their entirety by reference herein.

SUMMARY OF THE INVENTION

This invention and embodiments provide coating methods and apparatuses that overcome or minimize the disadvantages of dip coating and employ some of the advantages of slot die coating.

This invention and embodiments provide methods and apparatuses for coating objects without dip coating. The methods and apparatuses offer uniform, fast coating by dispensing coating material onto a rotated object in a helical pattern. In one aspect of the invention, a coating apparatus includes a coating device that dispenses coating material, a rotation device that rotates an object to be coated, and a movement device that relatively moves the coating device and the rotation device in a direction parallel to a rotation axis of the rotation device. The coating device in a specific embodiment includes a slot, extending substantially parallel to the rotation axis of the rotation device, through which the coating material is dispensed. Aspects of the present invention include the following:

A process comprising:

providing a moving substrate;

applying at least one coating layer onto the moving substrate with a slot die coater equipped with at least one position sensor mounted on at least one, and for example from one to about five end of the slot die coater;

sensing the position of the slot die coater relative to the moving substrate with at least one position sensor; and when the position of the slot die coater relative to the moving substrate deviates from a set of predetermined coordinates, iteratively adjusting the position of the die coater relative to the surface of the substrate to return to the set of predetermined coordinates.

An apparatus comprising:

a movement device that moves an object to be coated;

a slot die coater equipped with a position sensor mounted on at least one end of the slot die coater and which slot die coater controllably dispenses coating material onto the moving object; and at least one servor motor-controller system in electrical contact with the position sensor, wherein the position sensor senses the position of the slot die coater relative to the object and wherein the at least one servor motor-controller system adjusts the position of the slot die coater relative to the object if the position of the slot die coater relative to the moving substrate deviates from a set of predetermined coordinates.

This invention also provides systems and methods for coating a moving substrate using a slot die.

In various exemplary embodiments of the systems and methods of this invention, a charge generator layer dispersion is fed from a coating die containing a single slot onto a moving substrate. An electrical field is imposed between the coating die and the moving substrate. The dispersion particles that form the charge generation layer are changed. Thus, under the electrical field, these particles deposit on the substrate while still in the coating gap region.

A charge generating layer can be "developed" out using the single slot die to provide a charger generating layer (CGL) or both a (CGL) and a charge transport layer CTL simultaneously with the single slot. Thus, a two layer coating can be produced using only a single slot die and a single coating solution. This eliminates one entire coating sequence while improving both productivity and yield.

This invention can be used to produce electrostatographic charge generating material with an increased yield, better layer properties, thinner layers and increased throughput.

Embodiments of the present invention, include:

A process comprising:

providing a moving substrate for coating;

applying at least one coating layer onto the moving substrate with a slot die coater equipped with at least one position sensor mounted on at least one and for example from one to about five end of the slot die coater;

sensing the position of the slot die coater relative to the moving substrate with the at least one position sensor; and if the position of the slot die coater relative to the moving substrate deviates from a set of predetermined coordinates, then iteratively adjusting the position of the die coater relative to the surface of the substrate to return to the set of predetermined coordinates; and an apparatus comprising:

a movement device that moves an object to be coated;

a slot die coater equipped with a position sensor mounted on at least one end of the slot die coater and which slot die coater controllably dispenses coating material onto the moving object; and at least one servor motor-controller system in electrical contact with the position sensor, wherein the position sensor senses the position of the slot die coater relative to the object and wherein the at least one servor motor-controller system adjusts the position of the slot die coater relative to the object if the position of the slot die coater relative to the moving substrate deviates from a set of predetermined coordinates.

These and other embodiments of the present invention are illustrated herein.

DETAILED DESCRIPTION OF THE INVENTION

Figure 1:
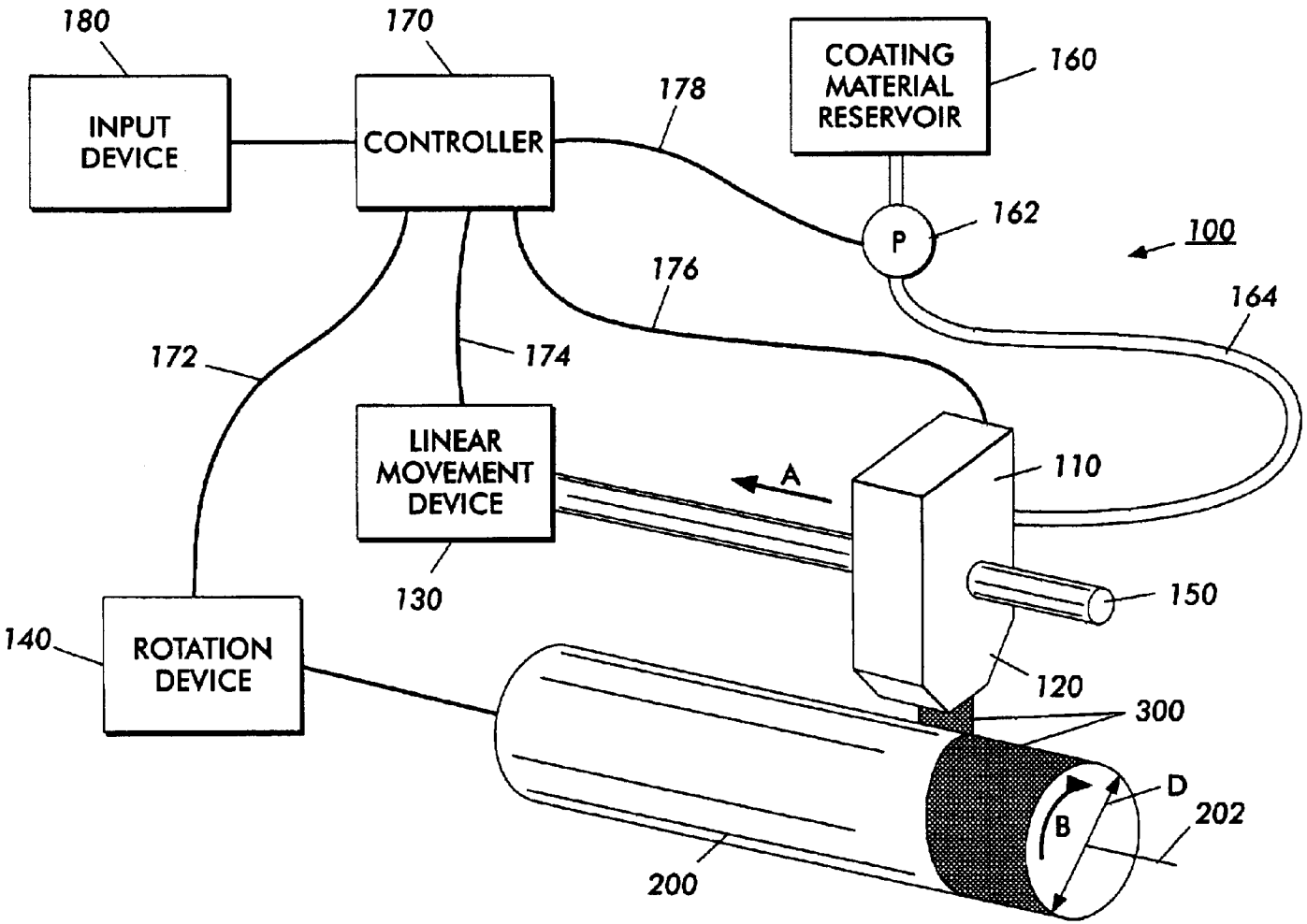
FIG. 1 shows an exemplary coating system which can be in embodiments be adapted for use in the present invention.

In embodiments of the present invention there is provided a process comprising:

providing a moving substrate for coating;

applying at least one coating layer onto the moving substrate with a slot die coater equipped with at least one position sensor mounted on at least one end of the slot die coater;

sensing the position of the slot die coater relative to the moving substrate with the at least one position sensor; and when the position of the slot die coater relative to the moving substrate deviates from a set of predetermined coordinates, then iteratively adjusting the position of the die coater relative to the surface of the substrate to return to the set of predetermined coordinates and to maintain uniform thickness of the applied coating layer.

The position sensor can contain, for example, a laser diode light beam emitter which irradiates or illuminates a specific surface region on the substrate and a position sensitive detector which detects reflected irradiation or coherent backscatter from the surface of the substrate. In embodiments, the position sensor can further contain a signal processor which translates an output current generated from the position sensitive detector into a voltage, and which voltage is proportional to the distance between the slot die coater and the moving substrate. In embodiments, the process can further contain applying, for example, from 2 to about 20 coating layers on the substrate. The layers in a specific embodiment applied sequentially although the layers can be applied concurrently or simultaneously, for example, with a plurality of die coaters of the present invention which are spatially separated or distributed at different locations with respect to the substrate. In embodiments, the process can further comprise curing the resulting coated layer or layers on the substrate, for example, with know curing means and methods such as irradiation, heat, pressure, or combinations thereof.

In embodiments, moving substrate that can be accomplished, for example, by mounting a cylindrical substrate on a rotating spindle. The moving substrate can alternatively be a continuous web passing between the die coater and a rigid backing support or optionally supported by a backing roller.

The at least one coating can be, for example, a photoconductive material, an electrically insulating material, a hole transport material, an anti-curl material, an adhesive material, a protective overcoat material layer, and combinations thereof. The at least one coating can be applied to the substrate in a thickness of from about 0.01 inches to about 10 inches and with a lateral width of from about 0.02 inches to about 40 inches.

In embodiments the present invention provides an apparatus comprising:

a movement device that moves an object to be coated;

a slot die coater equipped with a position sensor mounted on at least one end of the slot die coater and which slot die coater controllably dispenses coating material onto the moving object; and at least one servor motor-controller system in electrical contact with the position sensor, wherein the position sensor senses the position of the slot die coater relative to the object and wherein the at least one servor motor-controller system adjusts the position of the slot die coater relative to the object if the position of the slot die coater relative to the moving substrate deviates sufficiently from a set of predetermined coordinates. The moving substrate can be a rotating cylinder, for example, with a rotational rate and the slot die coating application rate or extrusion rate of material from the die coater to provide a single coating coverage rate of from about 1 square inch per second to about 1,000 square inches per second. In embodiments, the coating application rate from the die coater is continuous and provides a continuous coating layer of uniform layer thickness. Alternatively or additionally, the coating dispense rate or extrusion rate from the die coater can be discontinuous or intermittent and can provide a discontinuous coating of uniform layer thickness with, for example, well defined gaps or spaces between a preceding and a subsequent discharge of coating material from the die coater. In embodiments, the at least one coating can be a mixture of at least two co-reactive materials, for example, from two to about 10 co-reactive materials. Co-reactive materials can include, for example, a polymerizable monomer or co-monomers and an initiator compound, such as a free radical initiator and the like initiator compounds or mixture of initiator compounds.

Sufficient deviation is deviation from programmable specification and can be, for example, a metric established by a user or operator of the apparatus of the present invention, and can be, for example, readily programmed into or changed in the apparatus control system using commercially available programmable controllers.

In embodiments, a position sensor, such as the aforementioned laser diode sensor can be mounted on each end of the slot die coater for superior performance, and superior response time in the event of position adjustment(s).

The object for coating can be, in embodiments, a continuous or discontinuous web and wherein the long dimension or length of the slot die coater traverses the width of the web. The object can be, in embodiments, a cylinder wherein the long dimension or length of the slot die coater traverses the width of the cylinder. In embodiments, the object is a drum, a belt, a drelt, a solid core roller, or a hollow core roller.

The at least one servor motor-controller system adjusts the x-axis separation distance position between the slot die coater and the object.

The at least one servor motor-controller system adjusts the y-axis pitch position between the slot die coater and the object to maintain the slot die coater parallel to a rotational axis of a cylindrical object or parallel to a rotational axis of a cylindrical backing roller of a web object.

The at least one servor motor-controller system adjusts the z-axis yaw position between the slot die coater and the object.

The distance between the object to be coated and the slot die coater can be for example from about 1 to about 5, about 1 to about 3, or about 1 to about 2 thousandths of a millimeter.

The provision of a rotating cylindrical substrate can be accomplished by mounting the substrate on, for example, a rotating spindle or similar structures. The at least one coating layer material can be, for example, a photoconductive material. Alternatively or additionally, the at least one coating can be an electrically insulating material, such as, a polymer or mixture of polymers with little or no electrical conductivity. The process of the present invention can further contain, in embodiments, applying at least one coating of a photoconductive material over the resulting or previously deposited electrically insulating material layer. In embodiments, from about 2 to 10 successive coating layers of a photoconductive material can be applied over the resulting electrically insulating material layer. In embodiments processes of the present invention can further comprise applying at least one coating of a hole transport material over the resulting or previously deposited photoconductive material layer or layers. Still in other embodiments, processes of the present invention can further comprise applying at least one coating of a protective overcoating material over the resulting or previously deposited photoconductive material layer or layers, or hole transport material layer or layers.

In embodiments of processes of the present invention the at least one coating can be applied to the substrate by the direct write applicator, for example, in a thickness of from about 0.0001 inches to about 0.01 inches. In embodiments of processes of the present invention the at least one coating can be applied to the substrate by the direct write applicator, for example, in a lateral width of from about 0.002 inches to about 0.2 inches. The rotational rate of the rotating cylinder and the coating dispense rate from the direct write applicator can provide a single coating coverage rate and can be, for example, of from about 0.1 square inches per second to about 5 square inches per second. The coating dispense rate from the direct write applicator can be, in embodiments, continuous and provides a continuous coating layer of uniform layer thickness on the object for coating. Alternatively in embodiments the coating dispense rate from the direct write applicator can be discontinuous and provides a discontinuous coating of uniform layer thickness. The discontinuous coating dispense rate from the direct write applicator can be used to form specialty coated patterns on objects, for example, regions of the coated object, such as a photoreceptor, which have special properties, performance features, or appearances characteristics. In embodiments, the at least one coating can be, for example, a mixture of at least two co-reactive materials, such as different polymerizable monomer components, monomer and catalyst mixture or other co-reactant such as a free radical initiator compound and which coreactive materials can include other known curable materials.

A movement device that moves the direct writing applicator device relatively to the object in a direction parallel to a rotational axis of the object.

The direct writing applicator device can be, for example, a "Micropen" which is self-contained, completely integrated synchronous positive displacement pump or pumping system for producing precision deposited images of any fluid material or fluidizable material. Micropens are available commercially from MicroPen Incorporated, a subsidiary of OhmCraft Incorporated, of Honeyoye Falls, N.Y. Reference also for example, www.ohmcraft.com for additional description and of the apparatus and other applications and capabilities. Direct writing technology has been used in other areas to fabricate high precision printed circuit boards and other microelectronic devices comprising resistors, capacitors, interconnecting conductors, and the like devices. The feature sizes of such devices are very precise with respect to line width and line thickness. The direct writing apparatuses that are used to fabricate such devices are essentially high precision dispensing instruments that are capable of dispensing a wide range of liquids and pastes to form the above mentioned microelectronic devices.

The present invention contemplates a number of variations and permutations of the basic coating concept using a die coater with one or more position sensors as disclosed and illustrated herein, for example as follows:

depositing or writing a single layer organic photoconductor material or the like materials in a single step and on a single drum or substrate and which substrate is supported on a rotating shaft;

depositing a single layer organic photoconductor material or the like materials in a single step and on multiple drums or substrates and which substrates are supported end-to-end on a rotating shaft, for example as in a batch coating operation;

depositing a single layer organic photoconductor material or the like materials in a single step and on multiple drums or substrates and which substrates are supported end-to-end on a rotating shaft, and continuously conveyed past a direct write applicator, for example as in a continuous coating operation;

sequentially depositing multiple layers of organic photoconductor material or the like materials on a single drum or substrate and which substrate is supported on a rotating shaft;

sequentially depositing multiple layers of organic photoconductor material or the like materials on multiple drums or substrates and which substrates are supported end-to-end on a rotating shaft;

and sequentially depositing multiple layers of organic photoconductor material or the like materials on multiple drums or substrates and which substrates are supported end-to-end on a rotating shaft and continuously conveyed past a direct write applicator, for example as in a continuous coating operation.

In embodiments of the present invention the direct writing applicator device can deposit a spiral trace or pattern of coating material about, that is upon and around, the outer surface of the rotated object. The deposited coating material can in a specific embodiment subsequently flow, spread, or coalesce, for example, by way of various active forces including capillary action, surface centrifugation, surface tension, and the like forces, and combinations thereof to produce a smooth, homogenous coating layer of thin film coat on the object of the desired thickness. The direct writing applicator device can be positioned in embodiments from about 1.0 one thousandths of an inch to about 5 one thousandths of an inch from the object to be coated. The object or objects for coating can be, for example, a drum, a belt, a drelt, a solid core roller, or a hollow core roller, and the like objects. The rotation device can in embodiments simultaneously rotate from 2 to about 100 objects to be coated. The rotation device can simultaneously rotate and convey the article for coating past one or more direct writing applicators.

The direct writing applicator device can be configured to coat one or more, or a plurality of objects, for example, one or more drums on a single rotating shaft, or a plurality of objects rotated on a plurality of rotating shafts and which shafts are connected to one or more rotation devices. The rotation device can be a motor or equivalents devices and which device is capable of controllably driving the rotation of, for example, a shaft, a mandrel, and the like member, and which members are capable of adapting an object for coating for rotation with the rotation device.

In an embodiment, the apparatus of the present invention can be configured to provide a batch process and apparatus wherein the object or objects for coating can be loaded onto one or more support members, simultaneously rotated relative to one or more direct writing devices, and unloaded from the rotation device or devices to complete the batch operation.

In an alternative embodiment, the apparatus of the present invention can be configured to provide a continuous coating process and apparatus wherein the objects for coating can be continuously loaded, continuously rotated, continuously conveyed past the direct writing applicator for precision coating, and continuously unloaded from the rotation device in assembly-line fashion.

In embodiments, the apparatus of the present invention can be configured to coat multiple layers at a single coating station, that is, a single direct writing applicator or head. Other processing or conditioning accessories can be included within or adjacent to the single coating station single coating station, for example, a dryer or dryers, or other curing means, such as an ultraviolet light source or other source of heat or radiation, such as a laser beam.

Referring to the Figures, FIG. 1 shows an exemplary coating apparatus 100 disclosed in the abovementioned copending application U.S. Ser. No. 09/712,412, filed Nov. 21, 2000, the disclosure of which can, in embodiments be adapted for use in the present invention, for example, the mechanical hardware and system controls components. The coating apparatus 100 includes a coating device 110, a linear movement device 130 and a rotation device 140. The coating device 110 is in operative connection with a guide drive device 150, such as a screw drive, which in turn is in operative connection with the linear movement device 130. For example, the guide drive device 150 may include a rotating threaded member which is rotated by the linear movement device 130 and drives the coating device 110 back and forth. In this case, additional guides (not shown) can be used as necessary. Any other known or later-developed type of driving or guiding structure that drives the coating device 110 back and forth is also acceptable.

The rotation device 140 rotates a cylindrical object 200 that is to be coated. In FIG. 1, the rotation device 140 rotates the object 200 about a rotation axis 202 in the direction shown by arrow B. The rotation device 140 may, for example, have a structure similar to that of a lathe or the like. Additionally, the linear movement device 130 may be mechanically engaged with the rotation device 140, similar to the structure in a conventional metal lathe that turns a workpiece while feeding a cutting tool parallel to the axis of rotation. However, it should be appreciated that any device that effects rotary movement may be used as the rotation device 140, that any device that effects linear movement may be used as the linear movement device 130, and that the rotation device 140 and the linear movement device 130 do not necessarily have to be mechanically engaged, provided that their operations are properly coordinated with each other.

A slot die 120 is attached to the coating device 110. The coating device 110 is connected to a coating material reservoir 160 by a connection passage 164. A pump 162 pumps coating material 300 from the coating material reservoir 160. The pump 162 in a specific embodiment is a variable speed pump so that the flow rate may be adjusted. The coating material 300 flows through the connection passage 164, the coating device 110 and the slot die 120 and is dispensed onto the object 200 while the rotation device 140 rotates the object 200 and the linear movement device 130 moves the coating device 110 in the direction shown by arrow A. The slot die 120 is in a specific embodiment removably attached to the coating device 110 so that it can be removed and replaced with other slot dies 120, such as, for example, new slot dies or slot dies with different slot sizes.

A controller 170 is connected to the rotation device 140 by a link 172, to the linear movement device 130 by a link 174, and may also be connected to the coating device 110 by a link 176 and, or alternatively, to the pump 142 by a link 178. The controller 170 controls driving of the object 200 by the rotation device 140, and also controls movement of the coating device 110 by the linear movement device 130. Various control data may be input to the controller 170 via an input device 180, and any control programs and necessary data used by the controller 170 may be stored in a memory (not shown). A message output device such as a monitor or the like (not shown) may also be linked to the controller to prompt and confirm user input, and to output any relevant messages before, during or after processing, for example, "coating now in progress", and the like messages. Also, the controller 170 may detect various conditions, such as "coating material reservoir nearly empty" and the like conditions, and appropriately inform an operator via the message output device.

The controller 170 may be implemented on a programmed general purpose computer. However, the controller 170 can also be implemented on a special purpose computer, a programmed microprocessor or microcontroller and peripheral integrated circuit elements, an integrated circuit, a digital signal processor, a hardwired electronic or logic circuit such as a discrete element circuit, a programmable logic device, or the like devices. The memory (not shown) can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-rewriteable optical disk and disk drive, a hard drive, flash memory, or the like implementations. Similarly, the non-alterable or fixed memory can be implemented using any one or more of ROM, PROM, EPROM, EEPROM, an optical ROM disk, such as a CD-ROM or DVD-ROM disk, and disk drive, or the like implementations.

It will be readily appreciated by one of ordinary skill in the art upon comprehending the present invention that the a coating device 110 of coating system 100 can be, for example, conveniently replaced or substituted with the above-mentioned direct writing applicator or micropen to enable the coating apparatus and processes of the present invention. It will also be readily appreciated by one of ordinary skill in the art that similar or alternative configuration of system components can be used to obtain the desire coating results of the present invention.

Figure 2:
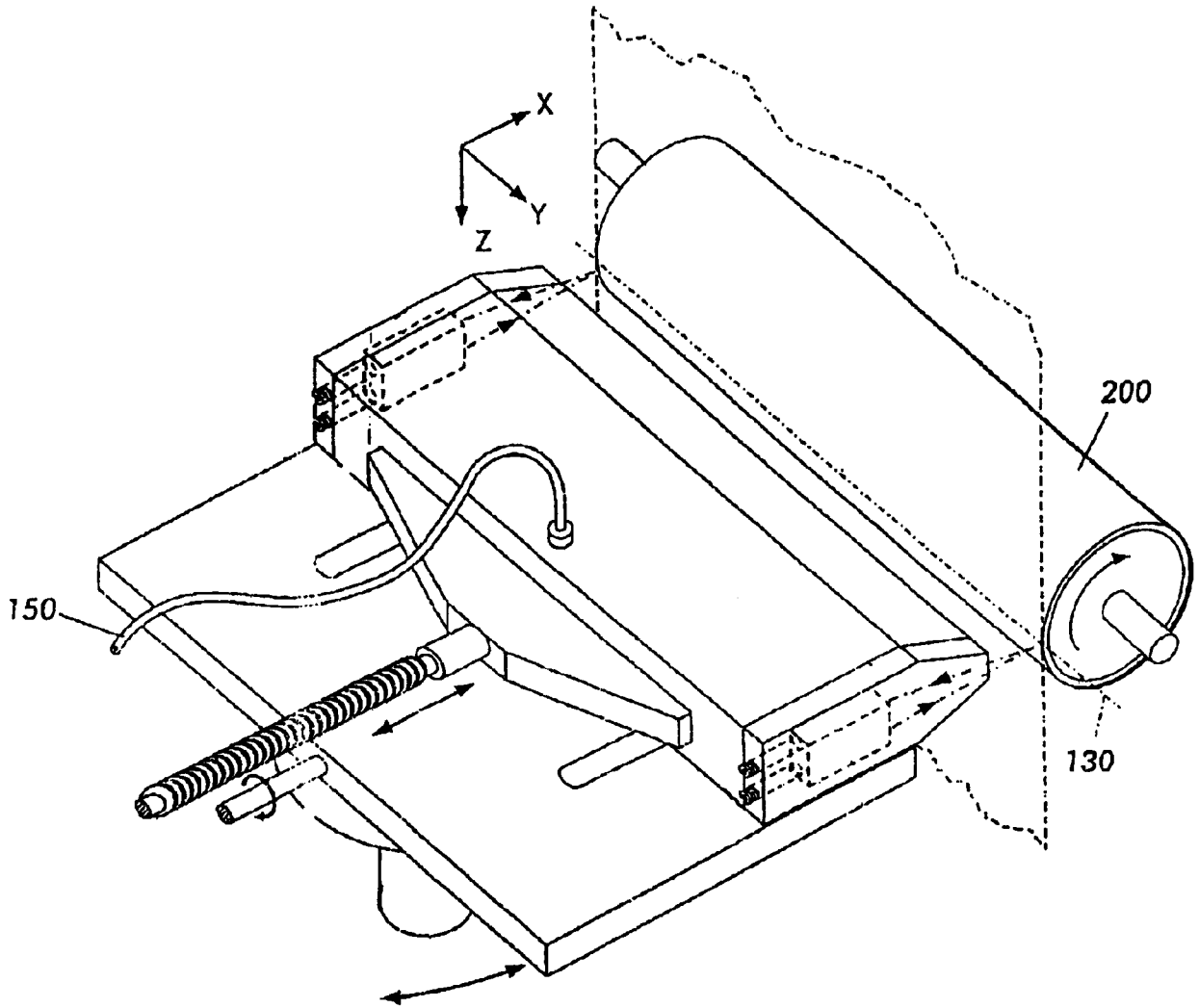
FIG. 2 shows a perspective view of an exemplary "full-width" coating die apparatus with laser positioning sensors in proximity to an exemplary substrate for coating in embodiments of the present invention.

FIG. 2 shows a perspective view of an exemplary "full-width" coating die apparatus with laser positioning sensors in proximity to an exemplary substrate for coating in embodiments of the present invention.

Figure 3:
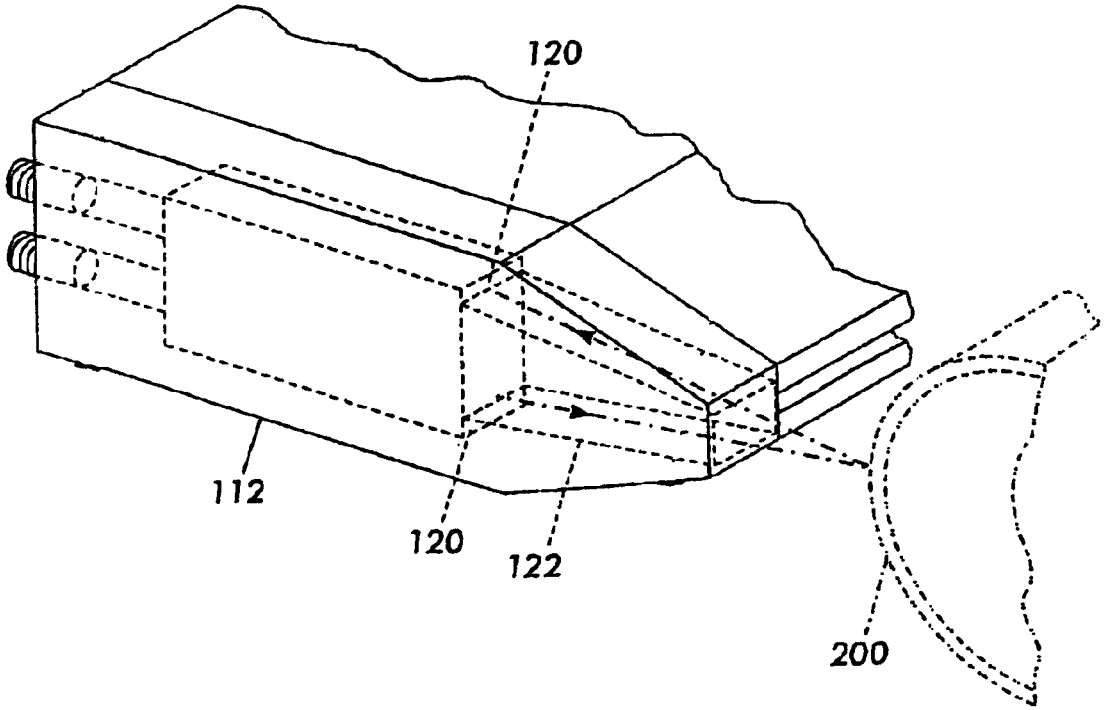
FIG. 3 shows a perspective view of an exemplary coating die apparatus with a detailed end-view of a laser positioning sensor in embodiments of the present invention.

FIG. 3 shows a perspective view of an exemplary coating die apparatus with a detailed end-view of a laser positioning sensor in embodiments of the present invention.

While this invention has been described in conjunction with the specific embodiments described above, other modifications, alternatives, and variations of the present invention may occur to one of ordinary skill in the art based upon a review of the present application and these modifications, including equivalents substantial equivalents, similar equivalents and the like thereof, are intended to be included within the scope of the present invention. Accordingly, the specific embodiments of the invention, as set forth above, are intended to be illustrative not limiting.

What is claimed is:

1. An apparatus comprising:

a movement device that moves an object to be coated;

a slot die coater equipped with a position sensor mounted on at least one end of the slot die coater and which slot die coater controllably dispenses coating material onto the substrate of the moving object; and at least one servo motor-controller system in electrical contact with the position sensor, wherein the position sensor senses the position of the slot die coater relative to the substrate of the object, the at least one servo motor-controller system adjusts the position of the slot die coater relative to the substrate of the object if the position of the slot die coater relative to the substrate of the moving object deviates from a set of predetermined coordinates, the position sensor contains a laser diode light beam emitter which irradiates a region on the substrate and a position sensitive detector which detects the reflection of the irradiation from the substrate of the object, and the at least one servo motor-controller system adjusts the y-axis pitch position between the slot die coater and the object to maintain the slot die coater parallel to a rotational axis of a cylindrical object or parallel to a rotational axis of a cylindrical backing roller of a web object.

2. The apparatus of claim 1, wherein a laser sensor is mounted on each end of the slot die coater.

3. The apparatus of claim 1, wherein the object is a web and the long dimension of the slot die coater traverses the width of the web.

4. The apparatus of claim 1, wherein the object is a cylinder and the long dimension of the slot die coater traverses the width of the cylinder.

5. The apparatus of claim 1, wherein the at least one servo motor-controller system additionally adjusts the x-axis separation distance position between the slot die coater and the object.

6. The apparatus of claim 1, wherein the at least one servo motor-controller system additionally adjusts the z-axis yaw position between the slot die coater and the object.

7. The coating apparatus of claim 1, wherein the slot die coater is positioned from about 1.0 millimeter to about 5 millimeter from the object to be coated.

* * * * *